US007018483B2

(12) United States Patent
Thoustrup

(10) Patent No.: US 7,018,483 B2
(45) Date of Patent: Mar. 28, 2006

(54) MACHINE AND METHOD FOR THERMAL CLEANING AND SEPARATION OF METAL PARTS

(75) Inventor: Asbjøm Thoustrup, Rosley (DK)

(73) Assignee: Maskinfabrikken Fornax A/S, Silkeborg (DK)

( * ) Notice: Subject to any disclaimer, the term of this patent is extended or adjusted under 35 U.S.C. 154(b) by 0 days.

(21) Appl. No.: 10/517,841

(22) PCT Filed: Jun. 11, 2003

(86) PCT No.: PCT/DK03/00382

§ 371 (c)(1),
(2), (4) Date: Dec. 15, 2004

(87) PCT Pub. No.: WO03/106059

PCT Pub. Date: Dec. 24, 2003

(65) Prior Publication Data

US 2005/0241676 A1 Nov. 3, 2005

(30) Foreign Application Priority Data

Jun. 17, 2002 (DK) ..... 2002 00920

(51) Int. Cl.
*B08B 5/00* (2006.01)

(52) U.S. Cl. ..... 134/19; 134/2; 134/42; 134/105; 134/107; 134/108

(58) Field of Classification Search ..... 134/105, 134/107, 108, 19, 2, 42
See application file for complete search history.

(56) References Cited

U.S. PATENT DOCUMENTS 3,610,260 A * 10/1971 Kearney ..... 134/12
4,208,221 A 6/1980 Rosen ..... 134/19
4,584,062 A * 4/1986 Sussmeyer et al. ..... 202/197
5,485,858 A 1/1996 Schmidt ..... 134/107
5,538,025 A * 7/1996 Gray et al. ..... 134/105
2001/0045142 A1* 11/2001 Hansmann et al. ..... 75/483

FOREIGN PATENT DOCUMENTS

| | | |
|---|---|---|
| DE | 4214885 | 11/1993 |
| DE | 19653702 | 8/1998 |
| DE | 19813865 | 9/1999 |
| EP | 0554026 | 8/1993 |
| EP | 0639658 | 2/1995 |
| GB | 2280451 | 2/1995 |
| WO | WO 01/98092 | 12/2001 |

* cited by examiner

*Primary Examiner*—Sharidan Carrillo
(74) *Attorney, Agent, or Firm*—James Creighton Wray; Meera P. Narasimhan

(57) ABSTRACT

Thermal cleaning and separation of metal parts is performed by a stator from an electric motor. Windings embedded in an organic, insulating material are placed and heated to 250°–500° C. under controlled conditions in a heating chamber, evaporating organic material and loosened windings. Flue gas is evaporated organic substances conducted through a closed pipe system to a condensator, where organic gases condense. The pipe system is designed so that condensate is conducted-on in the closed pipe system to a partly liquid filled vessel. Contents of this vessel are air and water that flow concurrently with the condensed flue gas as condensate, increasing content of organic material in the vessel and separating condensate from air. Air may be conducted to the oven for renewed absorption of organic material. All organic material evaporated from the heating chamber is collected in the vessel for later disposal in an environmentally correct and secure way.

20 Claims, 1 Drawing Sheet

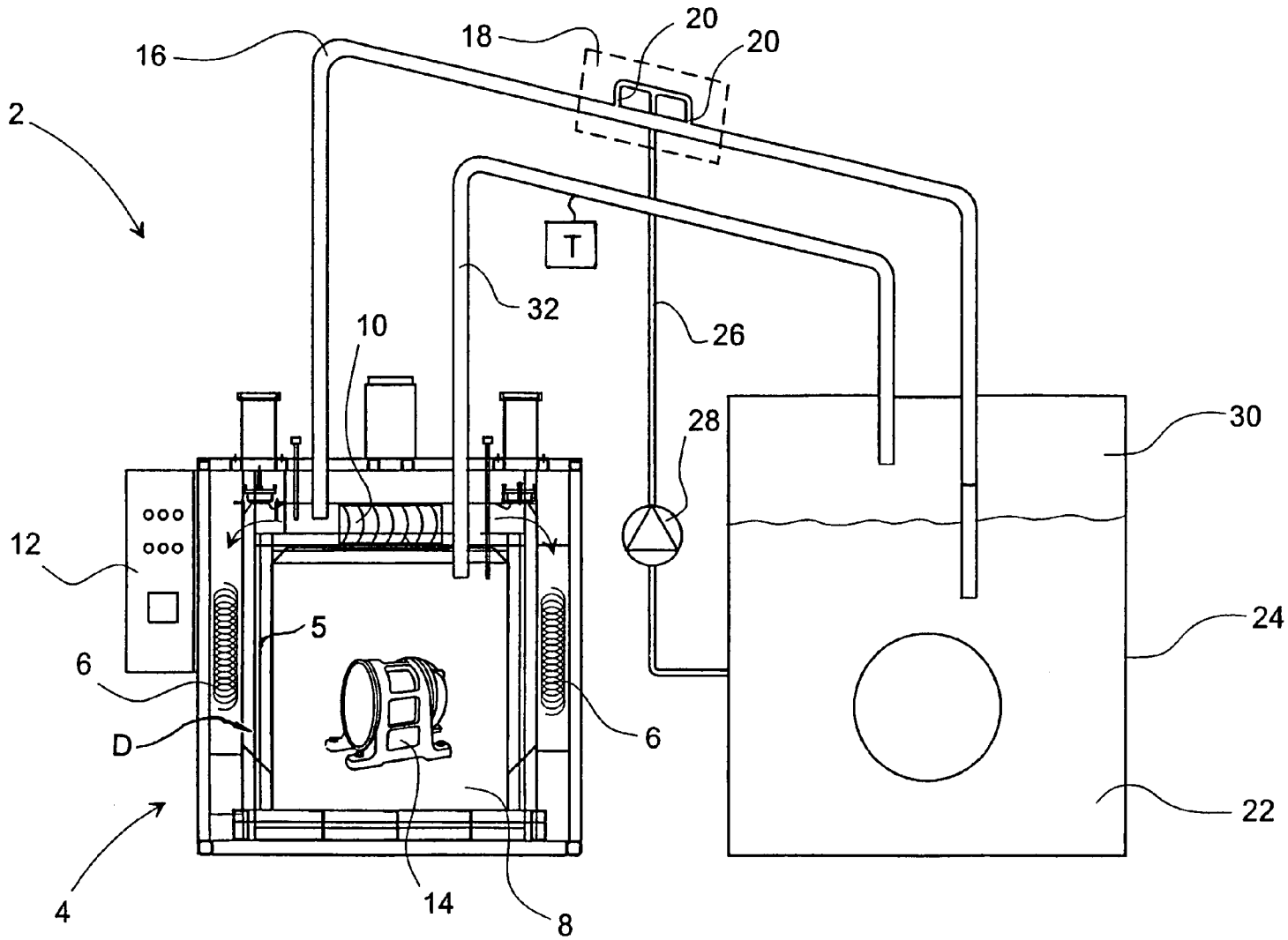
30
24
22
20
20
26
28
6
18
T
32
8
14
10
5
16
D
6
2
12
4

MACHINE AND METHOD FOR THERMAL CLEANING AND SEPARATION OF METAL PARTS

This application claims the benefit of Danish Application No. PA 2002 00920 filed Jun. 17, 2002 and PCT/DK03/00382 filed Jun. 11, 2003.

BACKGROUND OF THE INVENTION

The present invention concerns a machine and a method for thermal cleaning and separation of metal parts, preferably separating a stator from an electric motor, where the stator windings are embedded in an organic and insulating material, where the stator is placed and heated under controlled conditions in a heating chamber, where the organic material is evaporated, whereby the windings are loosened.

In connection with repair and renovation of electric motors, the stator is often to be rewound. A stator is wound with windings, normally copper windings, which are embedded in grooves in the stator housing by means of an insulating organic material, typically resin or varnish (Harz in German). This material is applied in fluid form and is set by means of heat.

Prior to rewinding, these windings are to be removed, which may be effected by mechanical removal, or by heating with a manual gas burner (uncontrolled), or by a controlled heating of the stator housing in an oven.

The latter method provides the best result, but such a facility has various drawbacks. The facilities are expensive so that small and medium repair shops cannot pay the ivestment in such a facility, and also there is an environmental aspect in this case.

When the stator is heated in the oven, the insulating organic material is brought to dissolve and is led away from the oven as flue gas. For environmental reasons, the flue gas is conducted to an afterburner that provides so strong heating of the flue gas that the organic elements are more or less completely burned off, after which the flue gas is led to the free surroundings.

Such a plant is not very economical since, as described above, it is necessary with an afterburner requiring some energy for cleaning the flue gas from organic substances.

It is also prior art to put the item in an alkaline bath which decompose the resin to some degree, after which the mechanical removal of the winding is facilitated.

It is the purpose of the invention to provide a machine and a method for thermal cleaning and separation of metal parts, preferably for releasing windings from a stator of an electric motor under controlled conditions in a heating chamber, where the evaporated matter, primarily organic material, is collected, and where the flue gas is cleaned for organic material.

SUMMARY OF THE INVENTION

The method according to the invention features that the evaporated insulating organic material, often resin or varnish, is conducted via a closed pipe circuit to at least one condensator, where the gaseous organic substances are condensed, and where condensate and air are conducted further on in the closed pipe system to a partly liquid filled vessel, from where the now cleaned air is conducted back to the heating chamber to a new cycle.

Furthermore, it is to be mentioned briefly that a method and an apparatus as described here may also be used for cleaning other items, e.g. suspension hooks from painting facilities, motor parts (removal of soot and coatings), nozzles from gluing equipment, screws and tools from plastic extrusion machines etc. These parts are not taken apart, but only cleaned.

In a preferred variant, the method according to the invention features placing e.g. a stator housing in a convection oven, which heats up the stator housing to a temperature in the range 250–500° C., preferably in the range 330–400° C. The heating may be effected by means of electric heating elements that e.g. are provided in connection with a circulating blower in the convection oven. Alternatively, the heating may occur in a heating chamber which is heated by means of infrared waves or by induction.

The flue gas formed by heating and primarily consisting of evaporated organic substances from the insulation in the stator housing is conducted through a closed pipe system to a condensator. In this condensator, condensing of the organic gases is effected. The pipe system is designed so that the condensate formed hereby is conducted further on in the closed pipe system to a vessel partly filled with liquid. The contents of this vessel consist of air and water, and concurrently with the condensed flue gas flows in in the form of condensate, the content of organic material increases in the vessel. Condensate is thus separated from air, and the air may again be conducted to the oven for renewed absorption of organic material. This method has the obvious advantage that all organic material evaporated from the heating chamber, is collected in the vessel and may later be disposed of in an environmental and secure way. Hereby, the immediate environment is saved from air pollution known from prior solutions.

By practical application of a machine for thermal cleaning and separation of metal parts according to the method, it has appeared that the plant has a surprisingly low energy consumption compared with prior art methods for separating e.g. windings from a stator.

An embodiment of the method as described above for thermal cleaning and separation of metal parts is typical with a condensing, where the said condensing occurs by the by the hot gas containing the organic substances being conducted into a condensator, where the gas is brought into contact with liquid from the vessel, where the liquid has a large surface, whereby the gas is cooled so that it condenses. The liquid may e.g. be supplied via a number of nozzles from where it is atomised in/supplied to the condensator.

The liquid which is brought to atomisation in the condensator is pumped up from the vessel and up to the nozzles in the condensator. The liquid is taken form a region between a possible floating layer of organic substances upon the water and above a possible layer of precipitate.

The atomising of the liquid implies a considerable increase of the liquid surface, and thereby the air can be cooled rapidly. This cooling causes condensing of the organic gases, after which air and condensate, as mentioned, are led down into the vessel. The air is now cleaned from organic substances and may be led back to the heating chamber again. The closed system ensures automatically that the oxygen in the air in the system at the beginning of the process is consumed over a very short period of time in connection with the evaporation, and since the facility is a closed system, new oxygen is not supplied. In this way, the oxygen percentage in the facility is reduced, and the danger of flue gas explosion is eliminated, as there is not sufficient oxygen in the system for an explosion to take place.

The oven, preferably a convection oven, is as mentioned connected with a condensator via one or more pipe connections, and through these pipes is conducted a mixture of air and evaporated organic substances. This flow is ensured by means of a circulation blower, which is preferably placed in connection with the oven. This circulation of air is balanced with the volume of the heating chamber and the amount of gas formed, so that heat transfer between air and stator housing occurs a quickly as possible simultaneously with the released gases are led to the condensator, whereby build-up of a explosion hazardous gas concentration is avoided.

By a method for thermal cleaning and separation of metal parts according to the invention, the vessel is partly filled with air and tap water, preferably tap water with additives enhancing the ability of the water to bind released organic substances.

By supplying additives providing increased ability of absorbing organic substances, the service life of the liquid may be prolonged, whereby a more economic operation becomes possible.

The preferred method according to the invention is that the system is a closed circuit where all flue gases are absorbed in the liquid as condensate, and where fresh air is not added during the process. As mentioned above, hereby the explosion hazard is minimised.

The method according to the invention for thermal cleaning and separation of metal parts furthermore includes that the cleaned air, which is conducted back to the heating chamber for a new cycle, contains water vapour and is usually saturated with water.

Hereby is achieved the advantage that the humid air, which is led back to the heating chamber, is mixed with the air already located in the heating chamber. The humid air then has the effect that a more rapid heat transfer occurs between the item and the air than if the air was dry. Hereby is achieved a not insubstantial reduction of the process time with lower costs as a consequence.

In a preferred embodiment, a machine for thermal cleaning and separation of metal parts, such as a stator from an electric motor, has the heating chamber connected to at least one condensator via a closed pipe system, where the gaseous organic substances are condensed, and where condensate and air are conducted further on in the closed pipe system to a partly liquid filled vessel, from where the now cleaned air via a second closed pipe system is conducted back to the heating chamber for a new cycle.

The machine operates by e.g. a stator housing being placed in the heating chamber in a convection oven, an infrared oven or an induction oven and is heated to 250–500° C., preferably to 330–400° C. From this oven there is pipe connection to a condensator and further on to a liquid vessel. From the uppermost part of this vessel there is a second pipe connection leading back to the oven chamber so that a closed circuit appears. With this closed circuit is achieved to the advantage that no leakage of organic gases occurs. All released organic gases/substances are collected as condensate in the liquid vessel, and may be disposed of in an environmentally correct way when the concentration in the vessel reaches a maximum level.

An alternative to replacing the liquid when the condensate concentration is too high is to have a cleaning device regenerating the liquid and connected with the vessel, whereby it becomes possible to process the liquid so that concentrate and water are separated, after which the water can be reused in the vessel.

The machine according to the invention is equipped with at least one condensator in which are a number of nozzles atomising/supplying liquid from the vessel into the gas stream, which is thereby cooled so that it condenses, and where the atomised liquid is supplied from the liquid vessel.

The condensator is disposed so that condensate appearing in the condensator flows on in the system and ends up in the vessel. The liquid brought to atomisation is pumped via a circulation pump in pipes from the vessel and is used repeatedly until a certain concentration of organic substances is attained.

Usually, the machine according to the invention is constructed so that the pipe system between liquid vessel and heating chamber is equipped with a temperature sensor.

This sensor constantly registers the temperature in the air supplied to the heating chamber from the liquid vessel. If this temperature exceeds a previously set maximum, the heating elements are switched off. In this way is ensured that organic gases from the stator housing are only released when the gases can be condensed in the condensator. This temperature sensor will switch off heating elements at too high temperature, irrespectively whether caused by clogged nozzles in condensator, pump failure or lack of liquid in the vessel. Furthermore, there may also be fitted a safety temperature sensor in the oven. By switched off heating elements, circulation of air/gas in the system is continued, while the temperature is falling to a level where the heating elements possibly can be switched on again.

The machine may furthermore be constructed so that the door of the heating chamber is designed as a pressure relief flap.

With this safety feature, a possible overpressure may be relieved to the surroundings. The door is equipped with safety chains with the purpose of safeguarding that the oven door does not open more than necessary by possible pressure relief.

The machine may furthermore be provided with usual equipment for data collection of e.g. operation time, operation temperature, item temperature, liquid temperature, gas concentration, and whatever may be of interest to measure.

BRIEF DESCRIPTION OF THE DRAWINGS

In the following, the invention is described with reference to the drawing, which, without being limiting, shows a preferred embodiment of a machine according to the invention, where the FIGURE shows a machine for thermal cleaning and separation of metal parts, such as a stator from an electric motor. But, as mentioned above, the facility may also be used for cleaning other items, e.g. suspension hooks from painting facilities, engine parts, nozzles from gluing equipment, screws and tools from plastic extrusion machines etc. These parts, however, are not taken apart but are only cleaned.

DETAILED DESCRIPTION OF THE PREFERRED EMBODIMENTS

On the FIGURE is seen a preferred embodiment of a facility 2 according to the invention. A convection oven 4 is heated with electric heating elements 6 which, however, may be substituted by another method without any problems. The air is brought to circulate in the heating chamber 8 by means of a circulation blower 10, and the facility 2 is controlled from an operation panel 12, here mounted in connection with the oven 4. In the heating chamber 8 is placed an item 14 in such a way that the air may freely circulate on all sides of the item. The heated air, which is now a mixture of air and evaporated organic material, is conducted via a closed pipe system 16 to a condensator 18, where the air mixture flows through and is cooled with atomised water from nozzles 20 placed in the condensator 18. These nozzles 20 are provided with water 22 from the vessel 24 via a pipe connection 26 and a circulation pump 28. The pipe system 16 between condensator 18 and vessel 24 is also formed so that condensate is automatically led to the vessel 24 where the condensate is absorbed in the water 22. The cleaned and wet air is now conducted on from the upper part 30 of the vessel 24 into another closed pipe system 32 and back to the oven chamber 8.

The pipe system between the liquid vessel and the heating chamber is equipped with a temperature sensor T. A door D of the heating chamber is designed as a pressure relief flap 5.

What is claimed is:

1. A method for thermal cleaning and separating of organic substances from metal parts, comprising the steps of placing and heating the organic substances and metal parts under controlled conditions in a heating chamber containing air, evaporating the organic substances, loosening the organic substances from the metal parts, conducting the evaporated organic substances via a closed pipe system to at least one condensator, condensing the evaporated organic substances to form condensate, conveying a mixture of the condensate from the condensator and the air from the heating chamber to a partly liquid filled vessel, cleaning the air, and supplying the cleaned air back to the heating chamber for use in a new heating cycle.

2. The method of claim 1, wherein the evaporating comprises heating the organic substances to form flue gas and wherein the conducting comprises conducting the flue gas into the condensator and forming the condensate.

3. The method of claim 2, wherein the liquid in the partly liquid filled vessel comprises tap water.

4. The method of claim 1, further comprising forming the closed pipe system as a closed circuit system and preventing ambient air from entering into the closed circuit system.

5. The method of claim 1, wherein the supplying the cleaned air comprises conducting the cleaned air to the heating chamber along with water vapor via a second closed pipe system.

6. The method of claim 1, wherein placing the metal parts comprises placing stators from electric motors, wherein the heating and evaporating the organic substances comprises heating insulating material of the stators, and wherein the separating comprises separating windings of the stators embedded in the insulating material.

7. The method of claim 2, further comprising contacting the condensate with liquid in the partly liquid filled vessel and absorbing the condensate in the liquid.

8. The method of claim 2, further comprising supplying the liquid from the partly liquid filled vessel to the condensator via plural nozzles.

9. The method of claim 3, further comprising supplying the tap water with additives and enhancing absorption of the organic substances in the tap water.

10. The method of claim 8, wherein the supplying the liquid comprises atomizing the liquid via the plural nozzles and supplying the atomized liquid to the condensator.

11. A machine for thermal cleaning and separation of metal parts from organic material comprising an oven including a heating chamber having air for receiving and heating the metal parts and the organic material, gas formed by separation and evaporation of the organic material from the metal parts, at least one condensator, a first closed pipe system connecting the heating chamber and the condensator for supplying the gas to the condensator, condensate formed in the condensator by condensing the gas, a partly liquid filled vessel connected to the condensator via the first closed pipe system, the condensate and the air being conducted from the condensator to the partly liquid filled vessel for absorption of the condensate and for generating cleaned air, and a second closed pipe system different from the first closed pipe system connecting the partially liquid filled vessel and the heating chamber for supplying the cleaned air from the partially liquid filled vessel back to the heating chamber for use in a new heating cycle.

12. The machine of claim 11, wherein the partially liquid filled vessel comprises tap water.

13. The machine of claim 12, further comprising a supply line connecting the partially liquid filled vessel and the condensator.

14. The machine of claim 11, wherein the first closed pipe system is a closed circuit system for preventing supply of ambient air.

15. The machine of claim 11, wherein the second closed pipe system is a closed circuit system for preventing supply of ambient air.

16. The machine of claim 11, further comprising a temperature sensor coupled to the second closed pipe system between the liquid vessel and the heating chamber.

17. The machine of claim 11, wherein the heating chamber further comprises a door forming a pressure relief flap.

18. The machine of claim 11, wherein the metal parts comprise stators from electric motors, wherein the organic substances form insulating material, and wherein the stators have windings embedded in the insulating material.

19. The machine of claim 12, wherein the tap water comprises additives for enhancing absorption of the condensate.

20. The machine of claim 13, wherein the partially liquid filled vessel comprises liquid, and wherein the condensator further comprises plural nozzles connected to the supply line for receiving the liquid from the partially liquid filled vessel, atomizing the liquid, and supplying atomized liquid to the condensator.

* * * * *

UNITED STATES PATENT AND TRADEMARK OFFICE

CERTIFICATE OF CORRECTION

PATENT NO. : 7,018,483 B2
DATED : March 28, 2006
INVENTOR(S) : Asbjørn Thoustrup It is certified that error appears in the above-identified patent and that said Letters Patent is hereby corrected as shown below:

Title page,
Item [75], Inventor, should read -- Asbjorn Thostrup --.

Signed and Sealed this

Sixteenth Day of May, 2006

JON W. DUDAS
*Director of the United States Patent and Trademark Office*